US007517411B2

(12) United States Patent
Hornsby et al.

(10) Patent No.: US 7,517,411 B2
(45) Date of Patent: Apr. 14, 2009

(54) METHOD AND APPARATUS FOR SURFACE TREATMENT

(75) Inventors: James Russell Hornsby, St. Louis, MO (US); Marcellus Rambo Benson, Chesterfield, MO (US); James Augustus Keefe, III, O'Fallon, MO (US); Joseph Lee McGowan, St. Charles, MO (US)

(73) Assignee: S.C. Johnson & Son, Inc., Racine, WI (US)

( * ) Notice: Subject to any disclaimer, the term of this patent is extended or adjusted under 35 U.S.C. 154(b) by 708 days.

(21) Appl. No.: 11/199,499

(22) Filed: Aug. 8, 2005

(65) Prior Publication Data

US 2006/0059640 A1 Mar. 23, 2006

Related U.S. Application Data

(60) Provisional application No. 60/600,507, filed on Aug. 9, 2004.

(51) Int. Cl.

| | |
|---|---|
| ***A46B 13/02*** | (2006.01) |
| ***A46B 13/04*** | (2006.01) |
| ***A47L 11/10*** | (2006.01) |
| ***A47L 11/28*** | (2006.01) |

(52) U.S. Cl. ..... 134/6; 15/22.1; 15/49.1; 15/50.1; 15/97.1; 15/98

(58) Field of Classification Search ..... 15/22.1, 15/49.1, 50.1, 97.1, 98, 103; 134/6
See application file for complete search history.

(56) References Cited

U.S. PATENT DOCUMENTS

| | | | | |
|---|---|---|---|---|
| 2,725,692 | A * | 12/1955 | Andreae | 451/356 |
| 3,251,087 | A * | 5/1966 | Platt, Jr. | 15/98 |
| 3,358,309 | A * | 12/1967 | Richardson | 15/22.1 |
| 3,497,898 | A * | 3/1970 | Sawyer | 15/98 |
| 3,613,141 | A * | 10/1971 | Sawyer | 15/98 |
| 3,972,088 | A | 8/1976 | Thomas et al. | |
| 4,321,095 | A * | 3/1982 | Argo et al. | 134/6 |
| 5,471,695 | A * | 12/1995 | Aiyar | 15/22.1 |
| 5,511,269 | A | 4/1996 | Watson et al. | |
| 5,890,249 | A * | 4/1999 | Hoffman | 15/4 |
| 6,081,956 | A * | 7/2000 | Boys | 15/21.2 |
| 2003/0167585 | A1 * | 9/2003 | Chen | 15/97.1 |
| 2004/0040579 | A1 * | 3/2004 | Smith | 134/6 |
| 2004/0103490 | A1 * | 6/2004 | Long et al. | 15/22.1 |
| 2004/0107522 | A1 * | 6/2004 | Paas | 15/98 |

FOREIGN PATENT DOCUMENTS

| | | | |
|---|---|---|---|
| FR | 2560033 | * | 8/1985 |
| GB | 2237734 | * | 5/1991 |
| JP | 1-293836 | * | 11/1989 |
| JP | 3-222905 | * | 10/1991 |
| JP | 10-295972 | * | 11/1998 |
| JP | 2001-37682 | * | 2/2001 |
| JP | 2001-70048 | * | 3/2001 |
| JP | 2001-275753 | * | 10/2001 |
| JP | 2003-102550 | * | 4/2003 |
| WO | WO 02/092405 A | | 11/2002 |
| WO | WO 2004/049893 | | 6/2004 |

* cited by examiner

*Primary Examiner*—Mark Spisich

(57) ABSTRACT

A surface treatment device, including a body, at least one actuable vibration component associated with the body, and a contact component associated with the body, the contact component configured to contact a target surface.

18 Claims, 3 Drawing Sheets

METHOD AND APPARATUS FOR SURFACE TREATMENT

CROSS-REFERENCE TO RELATED APPLICATION

This application claims priority to U.S. provisional patent application Ser. No. 60/600,507, filed Aug. 9, 2004, which is incorporated herein by reference in its entirety.

BACKGROUND

The present invention relates to devices, apparatus and equipment, and methods for treating surfaces or objects, including cleaning, sanitizing, and/or scrubbing surfaces. More particularly, in one embodiment, the invention relates to a surface treatment apparatus for creating a vibratory contact with a surface.

Mops such as wet mops and sponge mops, brooms, and scrubbers are manually-operated cleaning tools. In order to clean a surface using manually-operated cleaning tools, the user must mop, sweep, or scrub by exerting muscle strength. The larger the area to be cleaned, or the more difficult the area to be cleaned, the greater the chance of user fatigue.

In addition, manually-operated cleaning tools such as those mentioned above, have dry cleaning components unless the cleaning tool is immersed into a bucket, or unless the cleaning tool passes over liquid dispersed on a surface to be cleaned. The requirement of using both a cleaning tool and a cleaning liquid in order to perform cleaning tasks can be cumbersome for a user.

There is a need in the art for mechanized cleaning tools to reduce user fatigue, as well as enhance the cleaning effectiveness and efficiency. Further, there is a need in the art for a surface treatment cleaning tool that can deliver cleaning products to a surface to reduce the cumbersome effects of having separate cleaning tools and products.

SUMMARY

The present invention, in one embodiment, provides a surface treatment apparatus for providing home, garage and kitchen, countertop, sink, shower and bath cleaning. The surface treatment apparatus may be lightweight and powerful allowing for easy and effective treatment of surfaces.

In one embodiment, the apparatus has a body, at least one actuable vibration component, and a contact component configured to contact the target surface, wherein the contact component is vibrated, directly or indirectly, by the vibration component when it is actuated.

In one embodiment, two vibration components are included in the surface treatment apparatus. The two vibration components offer a twin oscillating motor system to provide surface scrubbing. For example, random vibration waves produced by the motor system can create a scrubbing action to break up dirt and stains. In another embodiment, the actuable vibration components vibrate in various directions. For example, one vibration component may vibrate in an X direction, and a second vibration component may vibrate in a Y direction.

One or more vibration components may be operated using a switch or multiple switches, in accordance with a further embodiment of the invention. In another embodiment, the vibration component may be triggered on in response to the contact component contacting the target surface. Furthermore, each vibration component may include a weight for facilitating vibration, in accordance with embodiments of the invention.

In an alternative embodiment, the apparatus has a handle associated with the body. The handle may be pivotable near the body. In another embodiment, the handle is attachable, adjustable, and/or modifiable. For example, the handle may be a twist and lock telescoping handle. In addition, the handle may accept extension poles for treating surfaces at longer distances. The handle, in another embodiment may include, a handle vibration dampening component such as a rubber bushing or gel pad in order to reduce vibration to the handle.

In yet another embodiment, the surface treatment apparatus may include a fluid reservoir and an associated nozzle and spray pump system for delivering fluids to the target surface. The nozzle and spray pump system may be motorized and/or controlled using a switch. In another embodiment, the surface treatment apparatus is water-proof.

In accordance with a further embodiment of the invention, a portion of the contact component is replaceable. The contact component may be a pad, brush, or sponge, for example. Furthermore, the contact component may be washable, reusable and/or interchangeable. In another embodiment, the contact component may attach to the body using a peel and stick feature.

The present invention, in another embodiment, comprises a method of using a surface treatment apparatus. The method includes providing a surface treatment apparatus having a body, at least one actuable vibration component associated with the body, and a contact component associated with the body, the contact component configured to contact a target surface, and placing the apparatus in contact with a surface to be treated. The surface treatment apparatus, according to another embodiment, may be used by actuating the vibration component. In another embodiment, the method of using the surface treatment apparatus includes applying a surface treatment substrate to the object or surface before actuating the vibration component.

The surface treatment apparatus may be useful for cleaning soap scum, hard water scale, dried food, pet stains, and mud. The surface treatment apparatus of the present invention may also be useful for cleaning mold buildup in bathrooms, garages, on vinyl siding, and in a pool, for example. Other uses for the surface treatment apparatus may include treating oil and grease stains, rust, paint, crayons, and shoe scuffs.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

The present invention relates to a surface treatment device. The device allows for simple and effective surface treatment by providing a vibration system that enhances the surface treating action.

Figure 1:
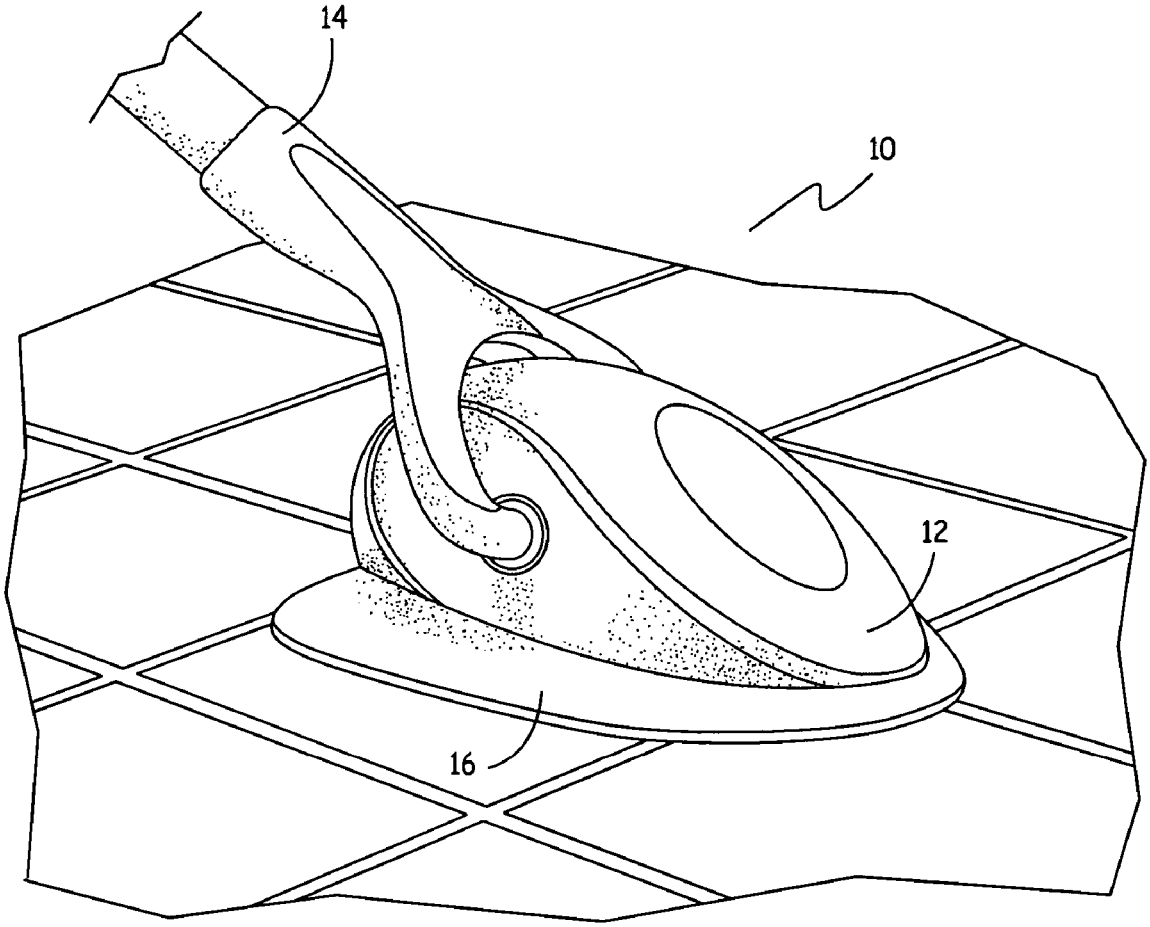
FIG. 1 depicts a perspective view of a treatment device according to one embodiment of the present invention.

FIG. 1 depicts a perspective view of a treatment device 10 according to one embodiment of the present invention. The treatment device 10 has a body 12, a handle 14, and contact component 16. The handle 14 is rotatably attached to the body 12 on either side of the body 12. Alternatively, the handle 14 can be attached to the body 12 in any known fashion. In a further alternative, the device 10 does not have a handle. In this invention, the body may be ergonomically shaped.

Treatment device 10 according to one embodiment includes a body 12 composed of a polypropylene housing, which offers a lightweight and durable chemically resistant material for the outer shell. In another embodiment, body 12 is securably attached to other treatment device 10 components such as handle 14 using stainless steel corrosion-proof outer screws.

The contact component 16 associated with the body 12, according to one embodiment, is a scrub pad. Alternatively, the contact component 16 is a bristle pad. In a further alternative, the contact component 16 is made of a microfiber material, a sponge material, a foam material, a pad material, an abrasive material, or any other known material for surface treatment of any known kind. In other alternatives, contact component chemically resistant or chemical proof material such as nylon or polypropylene. In yet another alternative, the contact component may be washable. Additionally, the contact component 16 may be shaped for treating corners and may include rounded, curved, or rolled edges for conforming to bathtubs and sinks. According to one embodiment, the contact component 16 is detachable and replaceable in any known fashion. For example, the contact component 16 can be removeably secured to the body 12 by a suitable function fitting arrangement, snap bit, screwed in place for attachment, complimentary fastening system, such as Velcro, or peel-and-stick.

Figure 2:
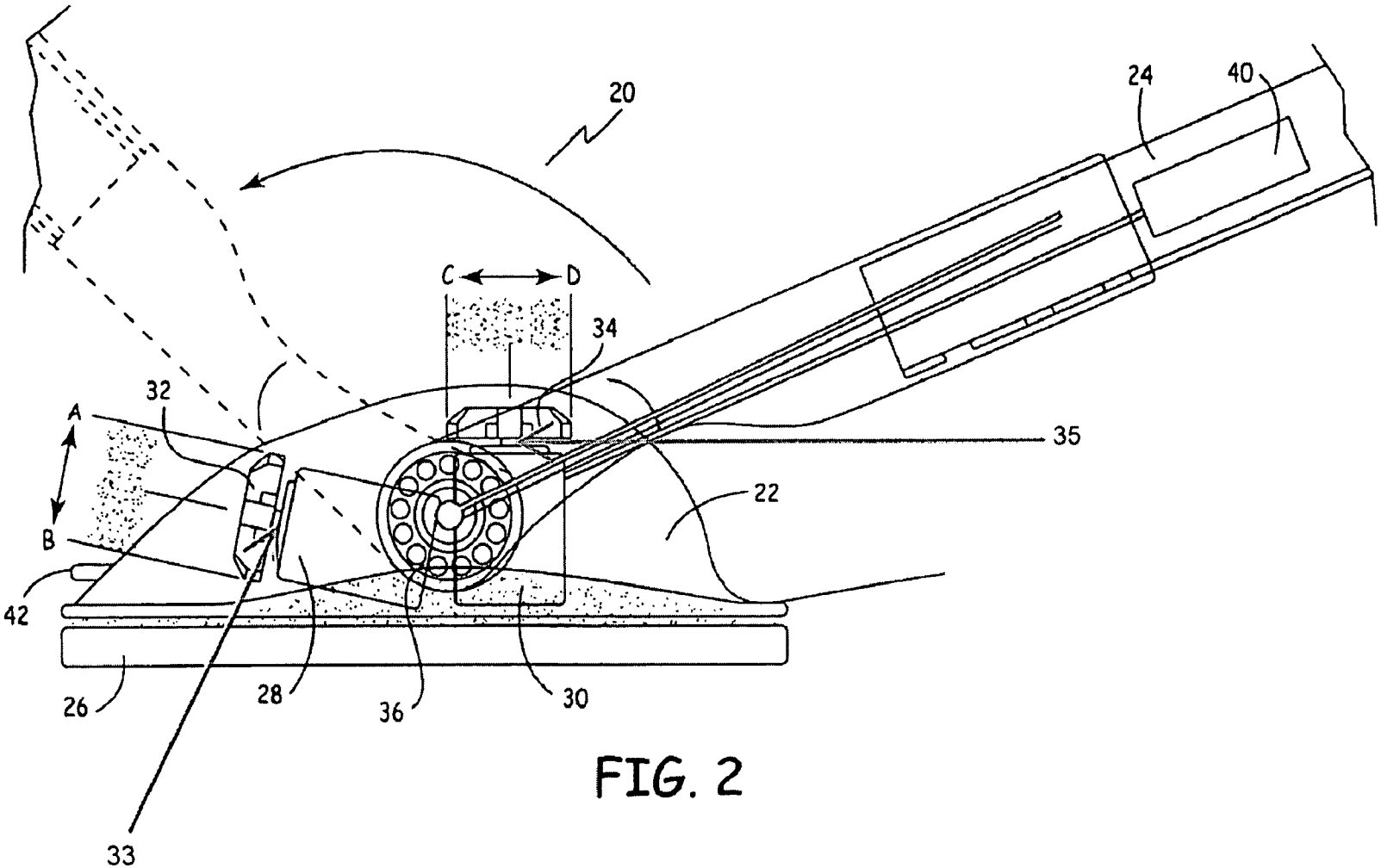
FIG. 2 depicts a side view of a treatment device, according to one embodiment of the present invention.
Figure 3:
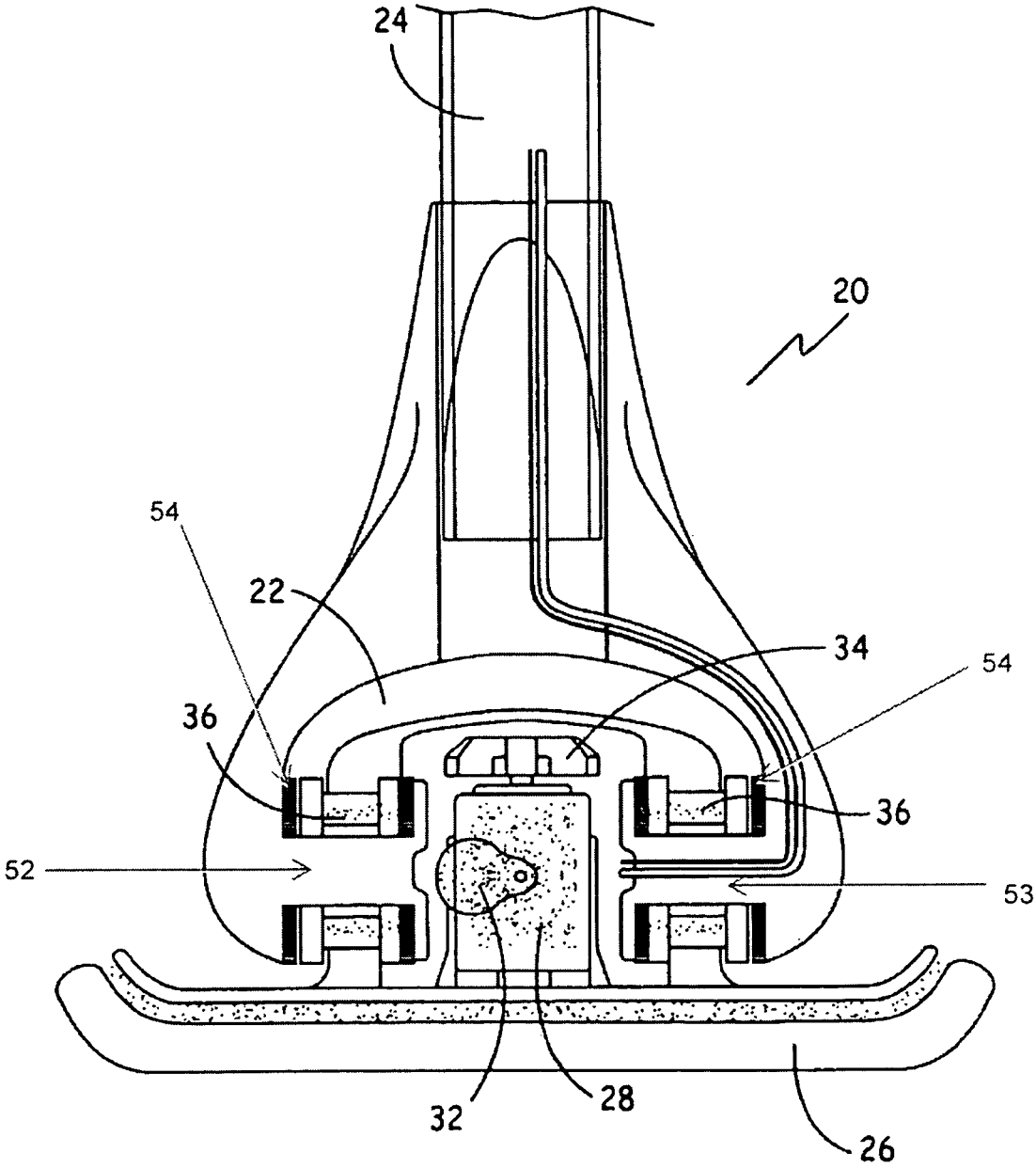
FIG. 3 depicts a front view of the treatment device, according to one embodiment of the present invention.

The apparatus of the present invention also has a vibration system coupled to the body and the contact component. FIG. 2 depicts a side view of a treatment device 20, according to one embodiment of the present invention. FIG. 3 depicts a front view of the treatment device 20, according to one embodiment. The treatment device has a body 22, a handle 24, a pad-like contact component 26, a peripheral edge and a generally flat central surface, a first motor 28 attached to a first weight component 32 by first motor shaft 33, and a second motor 30 attached to a second weight component 34 by second motor shaft 35.

The motors 28, 30 power the rotating of the weights 32, 34, which, according to one embodiment, are offset as known in the art. That is, motor 28 causes weight 32 to turn, while motor 30 causes weight 34 to turn. The motors 28, 30 cause the weights 32, 34 to rotate, thereby creating a vibration in the A-B direction and in the C-D direction as shown in FIG. 2. The vibration in two directions can enhance the treatment action of the device 20, thereby cleaning, buffing, polishing or providing any treatment action in two different directions. Alternatively, the apparatus 20 can have one motor powering the rotation of one weight to cause vibration of the apparatus 20.

The motors 28, 30, according to one embodiment, are 3 volt electric motors that can operate at 14,000 rpm. Alternatively, the motors can be any low voltage motors. In a further alternative, the motors can be any known motors for powering a vibration system.

The weights 32, 34, according to one embodiment, are 3 gram weights. Alternatively, the weights 32, 34 are any known weights for use in a vibration system.

The handle 24, in one aspect of the invention, is composed of a polypropylene/polyethylene which offers a strong, flexible lightweight handle. Alternatively, the handle 24 can be of any known material used in handles. The handle 24 in another aspect is rotatable at each point of connection with the body 22 around a pivot component 36 as shown in FIG. 2 by the arrow and the dotted lines showing the range of rotation of the handle 24. Alternatively, the handle can pivot in any known fashion. In one example, the handle 24 is both rotatable and lockable using a twist and lock component. In another example, the handle 24 is a telescoping handle having a twist and lock component. In yet another example, the handle 24 is modifiable so that the handle accepts extension poles. In a further alternative, the handle 24 is attachable and moveable in any known fashion. Yet another alternative includes a non-rotatable handle 24. Alternatively, the device 20 does not have a handle 24.

In another aspect of the invention, axles 52, 53 of the handle 24 are each coupled to a pivot component 36 that includes an anti-vibration component 54 such as a soft rubber busing or a gel component for absorbing handle vibration. Dampening the vibration to the handle 24 allows the vibrating motors 28, 30 to act on the contact component 26 while lessening unnecessary vibration at the handle 24.

In use, the device 20 can be used for treatment of any surface. According to one embodiment, a target surface is sprayed with a treatment fluid or treated with a treatment material prior to contacting the target surface with the contact component 26 of the device 20. Alternatively, no fluid is applied to the target surface prior to contacting the surface with the device 20. Once the contact component 26 is placed in contact with the target surface, the vibration system is actuated. That is the motors 28, 30 are actuated, thereby actuating vibration of the body 22 and/or the contact component 26 coupled thereto. The actuation can occur by any kind of button, switch, or other known actuation component (not shown). The body 22 can then be moved over the target surface in any desirable fashion to treat the target surface.

According to one embodiment, the treatment material is a cleaning fluid that is placed on the surface and then the contact component 26 is placed in contact with the surface to provide a scrubbing, wiping, or any other known type of action. For example, the treatment fluid could be a cleaning substance such as glass cleaner, surface cleaner, household disinfectant, or the like. In a further example, the treatment fluid could be any other type of cleaning substance, such as a herbicide, fungicide, or any other known liquid cleaning substance. Alternatively, the treatment fluid is a polishing fluid that is sprayed on the surface and then the contact component 26 is placed in contact with the surface to provide a polishing; buffing, or any other known type of action relating to polishing a surface. The treatment fluid in this embodiment can be any kind of liquid polishing fluid, surface protectant fluid or any other known type of fluid for improving or protecting the appearance of a surface. In a further alternative, the treatment material is any known material that is placed on the target surface and then the contact component 26 is placed in contact with the target surface for any known purpose and the motors 28, 30 are actuated to begin the vibration action.

In one embodiment, the device is water-proof, thereby allowing its use under water. For example, according to one embodiment, the device is water proof to a depth of three feet.

According to an alternative embodiment, the apparatus of the present invention can also include an integrated nozzle 42 and spray pump system powered by a suitable pump or pump/motor (not shown), configured to spray treatment fluid received in a container 40 of any known type defined by the apparatus, as shown in FIG. 2. The nozzle 42 can be any known spray nozzle, and the spray pump can be any known spray pump, such as any spray pump disclosed in U.S. patent application Ser. No. 10/863,817, filed on Jun. 8, 2004, now U.S. Pat. No. 7,328,859, which is hereby incorporated by reference herein in its entirety, or any other spray pump, such as, for example, a peristaltic pump. Alternatively, the liquid could be sprayed from the nozzle by a manual spray pump of any known type. Although depicted in specific locations in FIG. 2, the nozzle 42 and container 40 could be located in any portion of the device 20.

The apparatus according to one embodiment also has a safety lock associated with the device. The lock is configured to prevent actuation of the vibration system.

Appendix A has been attached herein to set forth exemplary features and functions of embodiments of the present invention.

Although the present invention has been described with reference to preferred embodiments, persons skilled in the art will recognize that changes may be made in form and detail without departing from the spirit and scope of the invention.

APPENDIX A

One embodiment of a Power Scrubber in accordance with the present invention

USED FOR:

Bath and Shower:
Tub and tile: Mold buildup, dried soap scum, hard water scale,
Kitchen:
Sinks, Floor, Ovens, Stovetops
Home:
Carpet: pet stains, spills and stains
Walls: crayons, shoe scuffs, grass, mud, rust
Outside:
Garage floor: Oil and grease stains, rust, latex paint spills. Pool tile and grout mold. Vinyl siding mold stains.

How one embodiment of the Power Scrubber Works

Patented "Twin Oscillating Motor System" creates superior scrubbing action.
Powerful DUAL motors spin 3 gram weights at 14,000 RPM on both "X and Y" axis's. Random Vibration waves break up stains.

Some Exemplary Features of one embodiment of the present invention

4 AA batteries, included
Powerful and Lightweight
Safety Lock prevents accidental "on"
Powerful Twin Oscillating Motor System
Water proof to 3 feet
Twist and Lock Telescoping Handle: Up to 30 inches
Accepts Standard Extension poles
Peel and Stick Pads: 1 Bristle, 2 Scrubby and 2 Nubby Pads
Gel Isolators insulate vibration from handle
Scrubbing pads shaped for corners & rolled edges conform to bathtubs/sinks.

Exemplary Materials/Advantages

TWO FA-130RA-2270 direct drive motors:
14,000 rpm @ 3 volts
Dual 3 gram Zinc alloy spinning weights: Corrosion-proof.
Unbreakable Polypropylene Housing: Lightweight - Excellent chemical resistance.
Gel Vibration Isolators: TPR (thermal polymer rubber) Chemical, APPENDIX A-continued One embodiment of a Power Scrubber in accordance with the present invention water proof.
PP (polypropylene) Handle and Wishbone: Strong, flexible and lightweight.
Twist-and-Lock bushing: Polypropylene-ethylene: Strong, compressible.
Nickel plated steel: Battery contacts and springs.
Hook and loop fastener: Quality industry brand.
Aluminum telescoping pole: Light and Strong.
Stainless 316: Outer screws: Corrosion Proof.
Bristle Brush Pad: Nylon. Chemically resistant
Scrubby Pad: Spun Nylon. Mildly abrasive
Nubby: PP: Tough, Chemical proof.

We claim:

1. A surface treatment apparatus comprising:

a body;

a first actuable vibration component associated with the body, the first actuable vibration component including a first motor with a first motor shaft;

a second actuable vibration component associated with the body, the second actuable vibration component including a second motor with a second motor shaft; and a contact component associated with the body, the contact component configured to contact a target surface, wherein the first actuable vibration component vibrates in a first direction, wherein the second actuable vibration component vibrates in a second direction, and wherein the first motor shaft and the second motor shaft are angled with respect to each other.

2. The apparatus of claim 1, wherein at least one of the first actuable vibration component and the second actuable vibration component is coupled to the contact component.

3. The apparatus of claim 1, further comprising a weighting component coupled to each of the first actuable vibration component and the second actuable vibration component for facilitating vibration.

4. The apparatus of claim 1, further comprising a handle having a first end associated with the body.

5. The apparatus of claim 4, further comprising a pivot component coupled to the first end of the handle.

6. The apparatus of claim 4, further comprising at least one handle vibration dampening component coupled to the first end of the handle.

7. The apparatus of claim 4, wherein the handle is adjustable.

8. The apparatus of claim 4, wherein the handle is attachable.

9. The apparatus of claim 4, wherein the first end of the handle is terminated in a y-shape, said y-shape pivotally coupled to said body.

10. The apparatus of claim 9, wherein each side of the y-shape terminated handle comprises an axle, said axles being aligned along a common axis line.

11. The apparatus of claim 10, wherein each axle supports a handle dampening vibration component.

12. The apparatus of claim 1, further comprising one or more switches for controlling each of the first and the second actuable vibration components.

13. The apparatus of claim 1, further comprising a fluid reservoir fluidly coupled to a nozzle for delivering fluids to the target surface.

14. The apparatus of claim 1, wherein the body is waterproof.

15. The apparatus of claim 1, wherein at least a portion of the contact component is replaceable.

16. A method of treating an object or surface, the method comprising:

providing a surface treatment apparatus according to claim 1 and bringing the contact component into contact with the object or surface.

17. The method of claim 16, further comprising actuating the first vibration component and the second vibration component.

18. The method of claim 17, applying a surface treatment substrate to the object or surface before actuating the first vibration component and the second vibration component.

* * * * *